US005154593A

United States Patent [19]

Konishi et al.

[11] Patent Number: 5,154,593

[45] Date of Patent: Oct. 13, 1992

[54] VANE PUMP WITH ANNULAR GROOVE IN ROTOR WHICH CONNECTS UNDERVANE CHAMBERS

[75] Inventors: Hideo Konishi; Junkichi Odai, both of Saitama, Japan

[73] Assignee: Jidosha Kiki Co., Ltd., Tokyo, Japan

[21] Appl. No.: 665,677

[22] Filed: Mar. 7, 1991

[30] Foreign Application Priority Data

Mar. 9, 1990 [JP] Japan ..... 2-59472

[51] Int. Cl.[5] ..... F04C 2/00; F04C 15/00

[52] U.S. Cl. ..... 418/77; 418/82; 418/268

[58] Field of Search ..... 418/77, 81, 82, 268

[56] References Cited

U.S. PATENT DOCUMENTS

| | | | |
|---|---|---|---|
| 3,516,767 | 6/1970 | Perkins | 418/81 |
| 3,598,510 | 8/1971 | Aoki | 418/81 |
| 3,915,598 | 10/1975 | Kalen et al. | 418/77 |
| 4,386,891 | 6/1983 | Riefel et al. | 418/81 |
| 4,507,065 | 3/1985 | Shibuya et al. | 418/81 |
| 4,795,325 | 1/1989 | Kishi et al. | 418/77 |

FOREIGN PATENT DOCUMENTS

| | | | |
|---|---|---|---|
| 1207661 | 9/1959 | France | 418/81 |

*Primary Examiner*—Richard A. Bertsch
*Assistant Examiner*—D. L. Cavanaugh
*Attorney, Agent, or Firm*—Flynn, thiel, Boutell & Tanis

[57] ABSTRACT

A device for improving the starting response of a vane pump and for reducing the power loss during a high speed operation of the pump. The vane pump includes a rotor formed with slits, in which slits vanes are slidably disposed. To drive the respective vanes into abutment against a cam ring, a pair of plates which hold the rotor and the cam ring sandwiched therebetween are formed with a plurality of arcuate grooves, into which a discharged oil is introduced. Rather than providing a narrow groove formed in the same plate as that in which the arcuate grooves are formed to provide a communication therebetween, an annular groove is formed in the lateral surface of the rotor to replace the narrow groove or in addition to the narrow groove, and is constructed so that the narrow groove is interrupted by the vanes as the vanes retract, the annular groove providing a communication between the arcuate grooves when a respective vane is driven radially outwardly.

6 Claims, 5 Drawing Sheets

VANE PUMP WITH ANNULAR GROOVE IN ROTOR WHICH CONNECTS UNDERVANE CHAMBERS

BACKGROUND OF THE INVENTION

The invention relates to a vane pump which may find its application in power steering apparatus for vehicle or the like.

Generally, a vane pump includes a cam ring having a substantially elliptical cam surface formed around its inner periphery, a rotor disposed for rotation within the cam ring, a plurality of vanes which are slidably disposed in slits formed around the outer periphery of the rotor at an equal circumferential interval, and plates which hold the combination of the cam ring and the rotor sandwiched therebetween. As the rotor rotates, each vane moves in sliding contact with the cam ring to increase or decrease the volume of the pump chamber which is defined between a pair of mutually adjacent vanes, thus performing an oil suction or discharge operation.

In a vane pump as described, the oil which is discharged from the pump is introduced into the inside of each slit in order to drive each vane through the slit of the rotor to achieve a positive contact of the vane with the internal surface of the cam ring. In the conventional practice, in their surfaces which are adapted to abut against the rotor, both of the plates are formed with four arcuate grooves which are positioned on a common circle, with the discharged oil being directly introduced into two of these grooves while the discharged oil is introduced into the remaining two grooves through a narrow path which communicates with the grooves.

Upon starting the vane pump, the vane which is slightly driven outward by the centrifugal effect, will abut against the cam to be pushed back in the opposite direction upon entering discharge stroke, whereby the oil is expelled from the slit into which the vane is driven. The expelled oil passes through the narrow path to be delivered to the discharge side of the pump. A flow resistance which the oil experiences during its passage through the narrow path causes an increase in the oil pressure inside the slit, thereby urging adjacent vanes outward which have not yet been significantly driven outward. By repeating such process, all of the vanes will eventually be completely driven outward for abutment against the cam ring to initiate the individual discharge operation.

The conventional vane pump as described above suffers from a number of difficulties, including poor starting response which is caused by a failure of a sufficient rise in the oil pressure inside the vane during its low speed rotation if the path which interconnects the arcuate grooves formed in both of the plates is not narrow enough, and an increase in the power loss and a rise in the oil temperature which may be caused by an increased flow resistance occurring during a high speed operation if the path is made excessively narrow.

SUMMARY OF THE INVENTION

Therefore, it is an object of the invention to provide a vane pump which exhibits an improved starting response and which reduces a power loss even during its high speed rotation.

The above object of the invention is accomplished by forming an annular groove in the lateral side of the rotor so that the annular groove may be interrupted by a vane as such vane retracts inward of the rotor while allowing the annular groove to provide communication between a plurality of arcuate grooves, which are formed on the surfaces of the plates which are used to hold the rotor and the cam ring sandwiched therebetween whenever the vane projects outward of the rotor.

DESCRIPTION OF EMBODIMENTS

Figure 1:
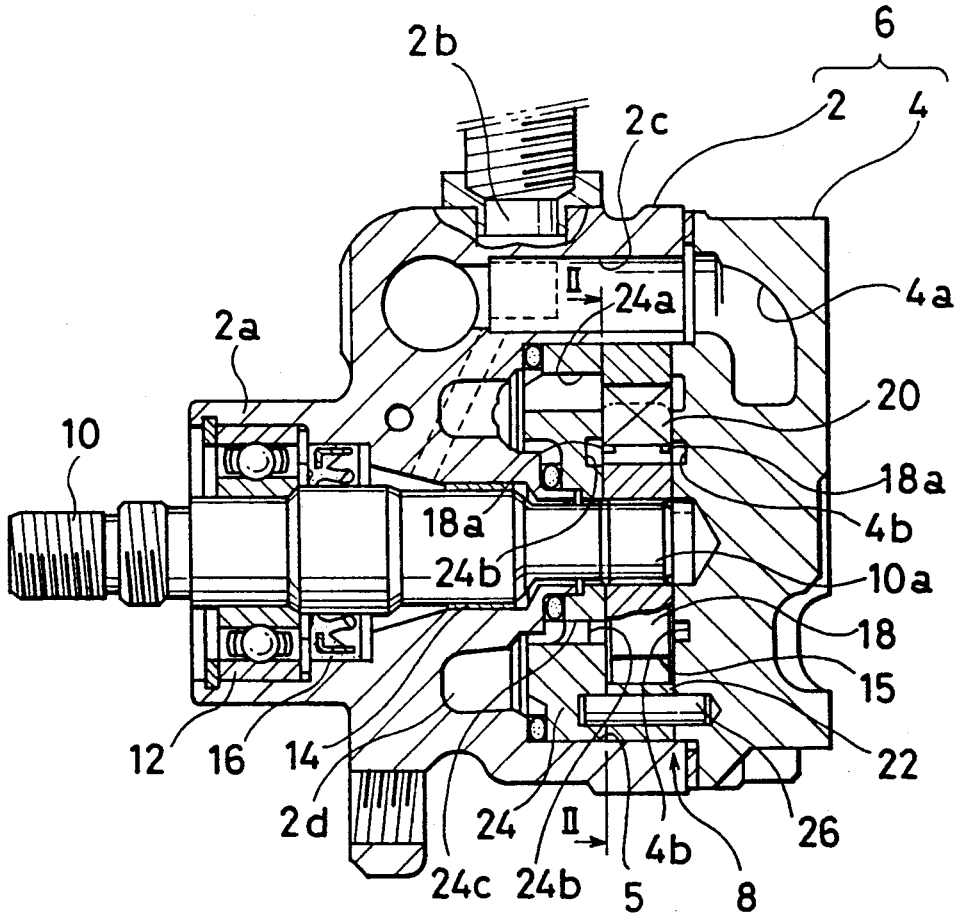
FIG. 1 is a longitudinal section of vane pump according to one embodiment of the invention.
Figure 2:
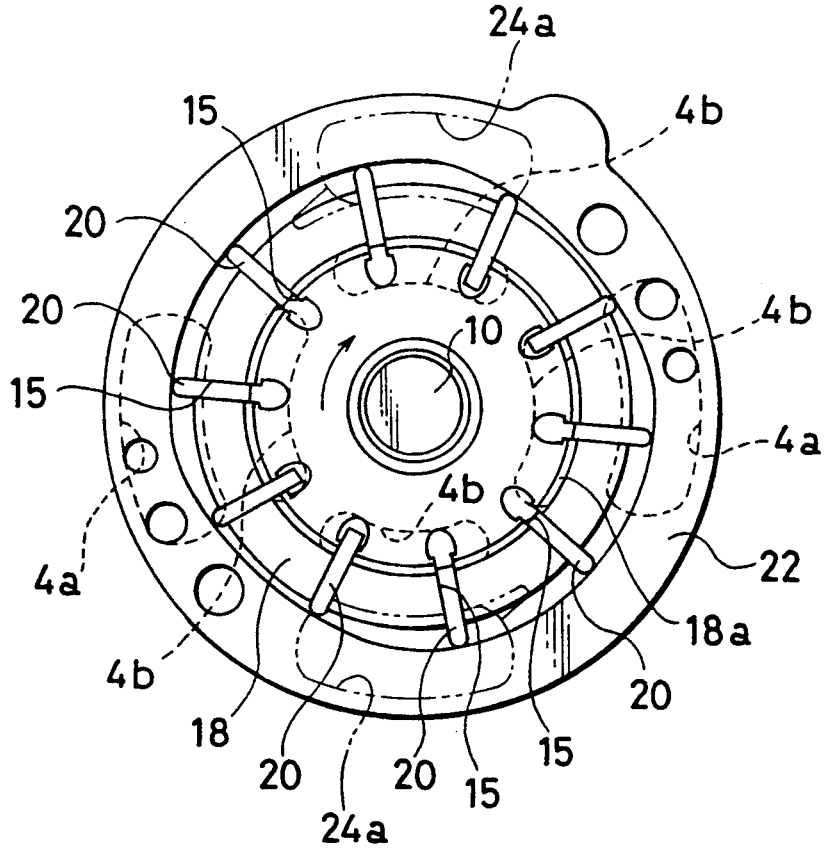
FIG. 2 is a cross section taken along the line II—II shown in FIG. 1.

Referring to the drawings, several embodiments of the invention will now be described. FIG. 1 is a longitudinal section, and FIG. 2 is a cross section taken along the line II—II, shown in FIG. 1, of a vane pump according to one embodiment of the invention. The pump comprises a substantially cylindrical front body 2 and a dish-shaped rear body 4 which are disposed in abutment against each other to define a pump body 6, in which a pump cartridge 8 is received.

The front body 2 includes a cylindrical portion 2*a* of a reduced diameter, through which an input shaft 10 is inserted into the pump body 6 and is rotatably supported by a pair of bearings 12 and 14. An oil seal is indicated at 16. The inner end 10*a* of the input shaft 10 which is disposed within the pump body 6 has a rotor 18 splined thereto for driving it for rotation. The rotor 18 is formed with radially extending slits 15 at an equal circumferential interval, with a vane 20 slidably fitted in each of the slits 15. A cam ring 22 having a substantially elliptical cam surface formed around its internal surface is disposed in surrounding relationship with the rotor 18.

The rotor 18 and the cam ring 22 are held sandwiched between a pressure plate 24 which is disposed inside the front body 2 and the rear body 4, with the rear body 4, the cam ring 22 and the pressure plate 24 being angularly positioned by a pin 26. The front body 2 and the rear body 4 are formed with a suction port 2*b* and suction passages 2*c*, 4*a*. Oil which is drawn into each pump chamber, defined by a pair of adjacent vanes 20, through the passages 2*c* and 4*a*, lows through a discharge passage 24*a* formed in the pressure plate 24 to be discharged into a discharge chamber 2*d* defined in the bottom of the front body 2.

At a location opposite to the inner end of each of the slits 15 formed in the rotor 18, the surface of the pressure plate 24 which faces the rotor 18 is formed with an arcuate groove 24*b*, which is divided into four segments, while arcuate grooves 4*b* are formed in the surface of the rear body 4 which faces the rotor 18 at a location corresponding to the arcuate groove 24*b*. The arcuate groove 24*b* formed in the pressure plate 24 communicates with the discharge chamber 2*d* through a through-opening 24*c*. In its both lateral sides, the rotor 18 is formed with annular grooves 18*a* which are located to be opposite to those portions of the arcuate grooves 4*b* and 24*b* which are situated toward their outer periphery. As will be noted from FIG. 2, such annular groove 18*a* extends across a portion of each slit 15 in which the vane 20 is received that is located toward their inner end, whereby when the vane 20 has been retracted to its inner limit, such annular groove 18*a* will be interrupted by the vane 20. On the other hand, when the vane 20 is driven outwardly to assume its outer limit, the annular groove 18*a* is effective to provide a communication between the separate arcuate grooves 4*b* and 24*b*. It is to be noted that the cross-sectional area of the annular groove 18*a* formed in the rotor 18 is chosen to be greater than that of a narrow path which is formed in a conventional plate (corresponding to the pressure plate and the rear body) to provide a communication between arcuate grooves.

Figure 3:
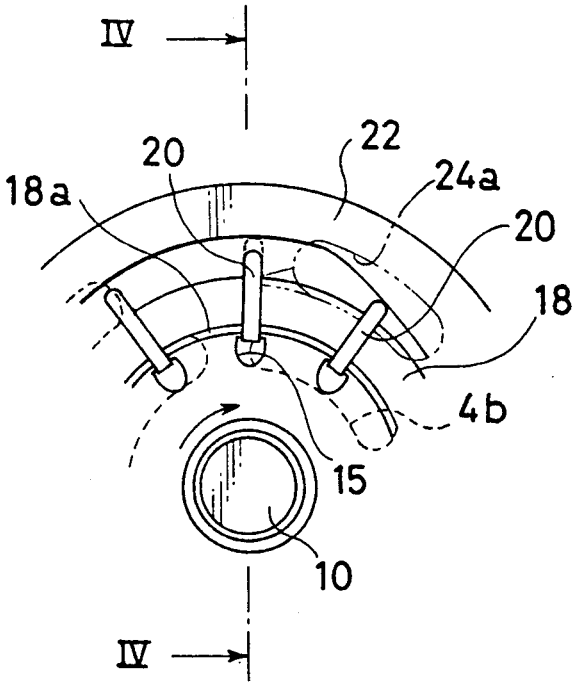
FIG. 3 is a fragmentary section illustrating the starting phase.
Figure 4:
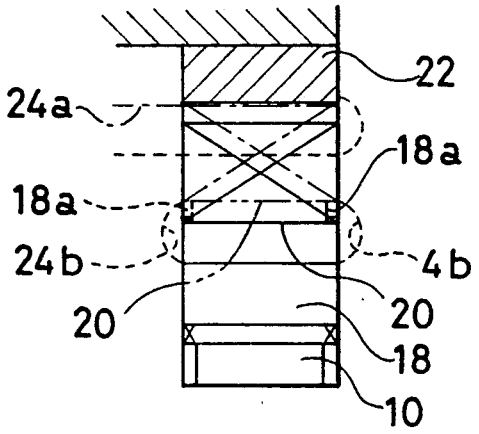
FIG. 4 is a cross section taken along the line IV—IV shown in FIG. 3.

Describing the operation of the vane pump described above, the vane 20 assumes its inner or retracted position within the slit 15 to interrupt the annular groove 18*a* before the pump operation is started (see solid line position in FIG. 4). However, as the rotor 18 begins to rotate, the vane 20 will be driven outward to a degree by the centrifugal effect (see a central vane shown in FIG. 3), and when it reaches a discharge stroke, it abuts against the internal surface of the cam ring 22 to be pushed back in the opposite direction, as indicated by a right-hand vane shown in FIG. 3. As the vane 20 is pushed back in this manner, the oil which is present inside the slit 15 in which such vane 20 is disposed will be expelled therefrom, and flows through the arcuate grooves 4*b* and 24*b* to push the vane 20 located in the adjacent slit 15 up into the abutment against the cam ring 22.

The fact that the oil inside the slit 15 which is expelled by the vane 20 which is pushed back is utilized in its entirety to push up the vane fitted in another slit 15 which is located within the common arcuate grooves 4*b* and 24*b* is effective to improve the starting response of the vane pump.

Figure 5:
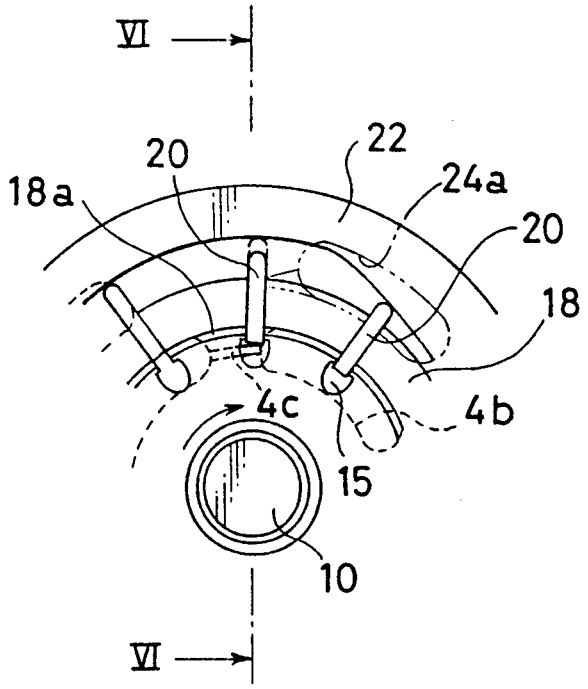
FIG. 5 and 6 are views corresponding to FIGS. 3 and 4, respectively, for a second embodiment of the invention.
Figure 6:
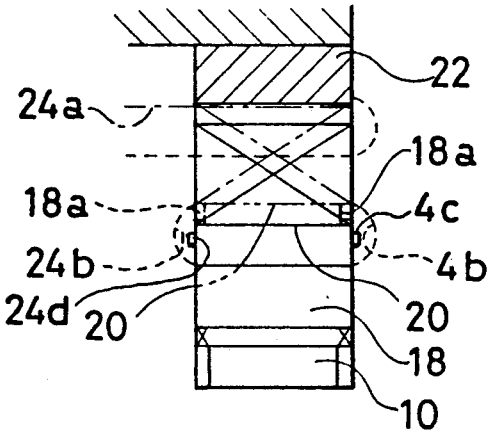

In the event the vane pump operates at high speed, the oil will flow from the arcuate grooves 4*b* and 24*b* disposed in the discharge region to other arcuate grooves 4*b* and 24*b* through the annular groove 18*a* which exhibits a greater cross-sectional area than that of a conventional path, whereby the resistance which such an oil flow experiences will be reduced, with a corresponding reduction in the power loss. In addition, a temperature rise of the oil is suppressed, thus preventing a degradation of the oil quality, FIGS. 5 and 6 show a second embodiment. Similar parts as those used to describe the first embodiment will be designated by like reference numerals and characters without repeating their description. In this embodiment, narrow paths 4*c* and 24*d* are formed in the rear body 4 and the pressure plate 24, respectively, for providing a communication between four arcuate grooves 4*b* and 24*b* in the similar manner as in a conventional arrangement. In addition, an annular groove 18*a* which is similar in nature to the described embodiment is formed in the opposite lateral surfaces of the rotor 18.

Upon starting, the operation of this embodiment is similar to that of conventional vane pump, in that the annular groove 18*a* formed in the rotor 18 is interrupted by the vane 20 and a communication between the arcuate grooves 4*b* and 24*b* is provided by narrow paths 4*c* and 24*d*. However, during normal operation, the vane 20 will be driven outward to enable a communication through the annular groove 18*a*, whereby the cross-sectional area of the flow channel which provides a communication between the arcuate grooves 4*b* and 24*b* increases to reduce a resistance presented to an oil flow and to reduce the resulting power loss. In addition, the cross-sectional area of the narrow paths 4*c* and 24*d* may be reduced than that of the prior art while enabling a reduction in the power loss, due to the presence of the annular groove 18*a* having an increased cross-sectional area, with consequent improvement in the starting response.

Figure 7:
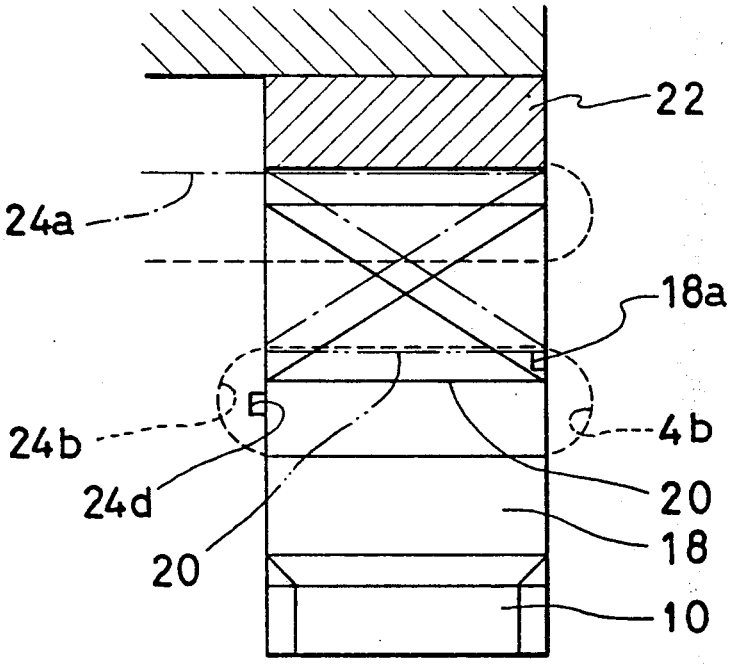
FIG. 7 is a view corresponding to FIG. 4 for a third embodiment of the invention.

Further, as shown in FIG. 7, it may be arranged that the annular groove 18*a* is formed on the only one surface of the rotor 18, thus either of the narrow paths for communicating the annular grooves 4*b* and 24*b* can be provided.

It is to be understood that the annular groove 18*a* need not be constructed so that the communication therethrough is completely interrupted by the vane 20 as it retracts, but may be constructed to provide an essential interruption while leaving partial communication.

While the invention has been illustrated and described above in connection with several embodiments thereof, it should be understood that the invention is not limited to the precise embodiments disclosed herein, but that a number of changes, modifications and substitutions therein will readily occur to one skilled in the art from the above disclosure without departing from the scope and spirit of the invention defined by the appended claims.

What is claimed is:

1. A vane pump having a pump housing, which vane pump is driven by a driven input shaft rotatably mounted in a space in the housing, including a cam ring having a cam around its internal surface, a rotor disposed for rotation within the cam ring, a plurality of vanes disposed in radial slits formed in the rotor for reciprocating motion, wherein first and second plates are disposed on the opposite sides of the cam ring and the rotor to hold them therebetween, thus causing the volume of a pump chamber defined by a pair of adjacent vanes to change to perform a fluid suction and discharge; wherein the first and second plates include a suction region where its pump chamber undergoes a suction stroke and in which a first groove is formed, wherein the first and second plates also include a discharge region where each pump chamber undergoes a discharge stroke and in which a second groove is also formed to allow oil to be introduced thereinto directly, the first groove in the suction region and the second groove in the discharge region communicating with a radially inner end of at least mutually adjacent pairs of the slits as they move therepast and with each other through at least one annular groove to allow the fluid in each first and second groove to act upon a radially inner end of the vane in the slits to urge the vane radially outwardly into abutment against the cam, the annular groove being oriented on the rotor so that the vane in each respective slit will substantially block fluid communication through the annular groove when the vane is radially inwardly positioned and allow fluid communication through the annular groove when the vane is radially outwardly positioned and so that fluid will enter the respective first and second groove via the annular groove adjacent a first vane in the radially outward position thereof and be substantially prevented from exiting the respective first and second groove by a second vane in the radially inward position thereof so that the entering fluid will be forced to urge the first and second vanes radially outwardly into engagement with the cam, a respective first vane in the discharge region eventually moving radially inwardly to eventually block the annular groove so that continued radially inward movement will cause the fluid so displaced by the first vane to urge the second vane radially outwardly.

2. The vane pump according to claim 1, wherein the rotor has a plurality of annular grooves for providing fluid communication between the first and second grooves.

3. The vane pump according to claim 1, wherein one of said first and second plates includes a passageway connecting mutually adjacent first and second grooves.

4. The vane pump according to claim 1, wherein both of said first and second plates include a passageway connecting mutually adjacent first and second grooves.

5. The vane pump according to claim 1, wherein the annular groove is completely interrupted by the vane in a radially inward position thereof.

6. The vane pump according to claim 1, wherein the first and second grooves are arcuate, and wherein the annular groove is located opposite to a portion of each first and second arcuate groove adjacent a radially outer periphery thereof.

* * * * *